United States Patent [19]

Lowe et al.

[11] 4,120,459

[45] Oct. 17, 1978

[54] IMPACT CRUSHER WITH RETRACTABLE AND TILTABLE FEED CHUTE

[75] Inventors: Keith B. Lowe, Appleton, Wis.; William R. Gray, Joplin, Mo.

[73] Assignee: Allis-Chalmers Corporation, Milwaukee, Wis.

[21] Appl. No.: 554,917

[22] Filed: Mar. 3, 1975

Related U.S. Application Data

[63] Continuation of Ser. No. 433,841, Jan. 16, 1974, abandoned.

[51] Int. Cl.[2] ..... B02C 13/04; B02C 13/286

[52] U.S. Cl. ..... 241/186.2; 241/239

[58] Field of Search ..... 241/18 R, 186.2, 186.3, 241/186.4, 189 R, 239, 240, 241

[56] References Cited

U.S. PATENT DOCUMENTS

| | | | |
|---|---|---|---|
| 2,609,153 | 9/1952 | Moore | 241/186.3 |
| 2,763,438 | 9/1956 | Medley | 241/186.2 |
| 3,202,367 | 8/1965 | Nixon | 241/186.2 |
| 3,516,613 | 6/1970 | Gilbert | 241/189 R |
| 3,857,519 | 12/1974 | Schafer et al. | 241/239 X |

*Primary Examiner*—Roy Lake
*Assistant Examiner*—E. F. Desmond
*Attorney, Agent, or Firm*—Arthur M. Streich

[57] ABSTRACT

An impact crusher is disclosed having a rotor carrying hammers arranged to strike and throw material against target members, and a material feed assembly. The feed assembly includes a downwardly inclined chute having depending cam followers which ride upon a cam surface having a horizontal portion and a downwardly curved portion at the end of the horizontal portion remote from the rotor. An actuating device is connected to the chute to move the chute and cam followers along the cam surface and down the curved portion thereof. Thus when a large rock bridges the space between the feed chute and the target members, and fails to drop into the range of the hammers, the chute is simultaneously retracted away from the rock as the upper end is tilted downwardly toward a horizontal position, to lower or drop the rock into the range of the whirling hammers.

5 Claims, 2 Drawing Figures

IMPACT CRUSHER WITH RETRACTABLE AND TILTABLE FEED CHUTE

This is a continuation-in-part of application Ser. No. 433,841 filed Jan. 16, 1974 now abandoned.

BACKGROUND OF THE INVENTION

1. Field of the Invention

This invention relates to impact crushers which have a rotor carrying hammers arranged to strike and throw rock to disintegrate upon impact with target members spaced from the rotor, and in particular to an improved feed assembly for such a crusher.

2. Description of the Prior Art

It is known that impact crushers of the aforesaid type have been provided with a downwardly inclined feed chute having an angle of incline which is fixed relative to the crusher wall through which the feed chute projects. An example of such a crusher is disclosed in British Pat. No. 498,415 of Jan. 9, 1939. With such a crusher, if a rock bridges the space between the feed chute and a target breaker bar and fails to drop into the range of the hammers, it becomes necessary to open the housing in order to clear the crusher of such material.

U.S. Pat. No. 2,767,928 of Oct. 23, 1956 discloses an impact crusher with a feed chute having an angle of incline which can be adjusted in a manner permitted by support brackets having upwardly turned arcuate chute support surfaces. With such an arrangement the angle of the chute can be adjusted to move the lower end away from target bars while the upper end moves toward the target bars, or to move the lower end toward the target bars while the upper end moves away from the target bars. However, this arrangement is not operative to move the entire chute away from the target bars while tilting the upper end downwardly toward a horizontal position, as is possible with the hereinafter described present invention.

German Pat. No. 1,032,647 of June 19, 1958 discloses an impact crusher having a feed chute held at its opposite longitudinal edges between guide rails at a constant angle of incline, but with the chute being withdrawable and movable away from a rotor and target bars by engaging a hook depending from the underside of the chute to pull the chute up the incline of the guide rails. Thus the upper end of the chute is raised to a higher elevation as the chute is pulled away from the rotor and target bars, and is difficult to operate and/or ineffective to drop a rock bridging to the top of the chute until the chute is completely withdrawn from between the guide rails.

U.S. Pat. No. 2,862,669 of Dec. 2, 1958 discloses an impact crusher with a chute that can be raised or lowered but without changing the angle of the chute or the distance of the chute from an adjacent rotor.

U.S. Pat. No. 2,889,119 of June 2, 1959; U.S. Pat. No. 3,157,367; and U.S. Pat. No. 3,701,485 disclose chutes that pivot about an axis beneath the chute and near the upper end of the chute. Such a chute adjusting arrangement, like the aforementioned U.S. Pat. No. 2,767,928, provides adjustability whereby when the lower end of the chute is moved away from the target bars the upper end of the chute moves toward the target bars.

U.S. Pat. No. 2,644,644 of July 7, 1953 and U.S. Pat. No. 3,202,367 of Aug. 24, 1965 disclose an arrangement for lowering the upper end of a chute about an axis beneath the chute and near the lower end of the chute.

However, when a rock bridges the space above the whirling hammers and between a target bar and the lower end of the chute, the arrangement of this patent is ineffective to drop the rock into the range of the hammers because as the upper end is lowered, the lower end is raised thus lifting such a bridged rock further away from the range of the whirling hammers.

None of the aforementioned arrangements for adjusting the angle of a feed chute to drop a rock bridging the space above the hammers and between the chute and target bars, are therefore effective to lower or drop both rock bridging high and rock bridging low on the inclined feed chute.

SUMMARY OF THE PRESENT INVENTION

It is an object of the present invention to provide an impact crusher with an improved support assembly for a downwardly inclined feed chute, operative to drop a rock bridging the space above the rotating hammers and between the chute and target bars, regardless of whether the bridging rock is resting on the chute near its upper end or near its lower end.

According to the present invention the feed chute assembly is operative to move the entire chute away from the rotor and target bars, while simultaneously tilting the upper end of the chute downwardly toward a horizontal position, to lower or drop high or low bridging rock into the range of the whirling hammers. Such motion of the chute is achieved by a camming arrangement which supports the chute relative to side walls.

In a preferred embodiment of the present invention the downwardly inclined feed chute is provided with two pairs of depending cam followers which ride upon a pair of horizontally spaced cam surfaces each having a horizontal portion and a downwardly curved portion at the end of the horizontal portion remote from the rotor. A crank arm, which is turned by a fluid pressure operated articulated arm, is connected to the cam followers to move the pair of cam followers remote from the rotor, along the cam surface and down the curved portion thereof. Thus the chute is moved away from the rotor and target members while the upper end of the chute is simultaneously tilted downwardly toward a horizontal position.

Other features and objects of the invention that have been attained will appear from the more detailed description to follow with reference to an embodiment of the present invention shown in the accompanying drawing.

DESCRIPTION OF THE PREFERRED EMBODIMENT

Figure 1:
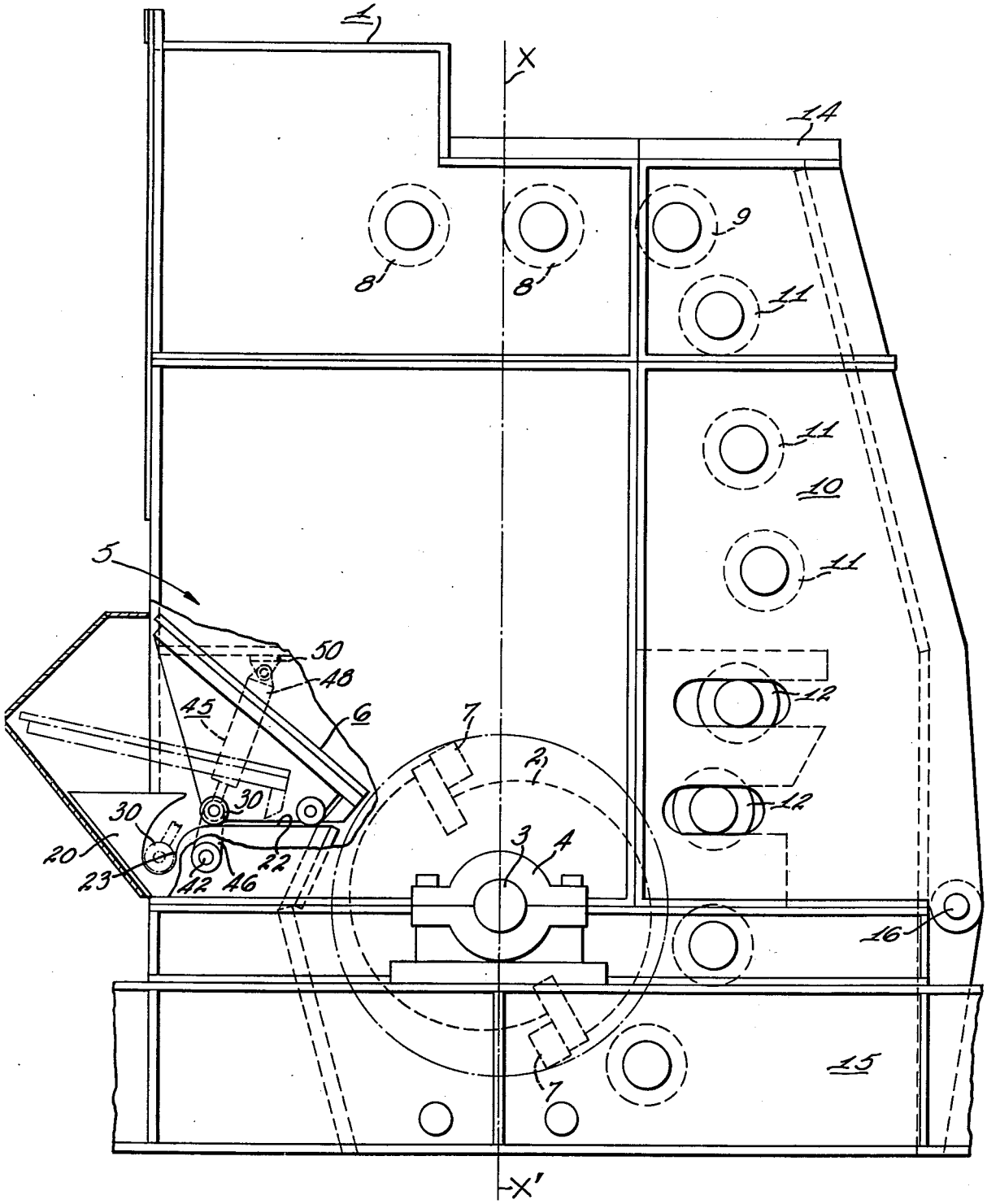
FIG. 1 of the drawing is a view in elevation and partly in section, showing an impact crusher according to the present invention.

Referring to FIG. 1, an impact crusher is shown which comprises a housing 1 having disposed within a lower area thereof a rotor 2 mounted on a shaft 3 which is carried by suitable journal bearings 4. The housing 1 defines a material feed opening 5 over a feed chute 6 inclined downwardly toward the rotor 2. The feed chute 6 is part of a feed assembly which will hereinafter be described in detail. For the purpose of describing the general construction of the machine, it is sufficient to note that chute 6 serves the conventional function of delivering rock to hammers 7 attached in a suitable manner to the rotor 2.

Chute 6 directs feed rock to rotor 2 at a location where its hammers 7 are ascending with the result that the impact of hammers 7 on rock breaks the rock into smaller particles which are thrown upwardly to break into even smaller particles upon impact with a complement of primary target breaker bars 8 and 9 which are carried by the casing 1. A secondary crushing occurs when such particles drop downwardly from bars 8 and 9 to be again struck by hammers 7 and thrown toward a discharge area 10 where the particles impact with a vertical array of secondary target bars 11. Close to the periphery of rotor 2, one or more adjustable and yieldable breaker bars 12 may be arranged. Adjustable and yieldable mounts such as for bars 12 are well known and one example of such mounts is shown in U.S. Pat. No. 2,486,421 of Nov. 1, 1949. Any particles not passing between the bars 11 and into discharge area 10, progress downwardly toward the bars 12 where such particles are subjected to a final crushing as the particles are nipped and urged through the space between rotor 2 and bars 12 to the lowest portion of the discharge area. The casing 1 may include a pivotal portion 14 connected to base structure 15 by a hinge 16, operative to open the casing and provide access to the internal mechanisms.

The input material feed assembly, of which chute 6 is a part will now be described. The chute 6, because it is arranged on the hammer ascending side of rotor 2, is located in casing 1 on a side of a vertical plane X–X' through the axis and shaft of rotor 2, opposite some of the target breaker bars 8 and all of the target bars 9 and 11. The chute 6 is therefore spaced a considerable distance from such target bars. But one of the desirable characteristics of these machines is its ability to receive and crush very large rocks or pieces of rock obtained by blasting with explosives. It therefore sometimes happens that a piece enters the machine so large that it bridges the space over the rotating hammers 7 and between the chute 6 and one of the target bars, usually one of the secondary crushing target bars 11.

In order to lower or drop such a bridging rock into the range of the whirling hammers 7, chute 6 is supported by camming means shown in FIG. 1 as including a wall member 20 defining a cam surface having a horizontal portion 22 and downwardly curved portion 23 at the end of the horizontal portion 22 remote from the rotor 2. The manner in which chute 6 is constructed to ride on and be supported by the cam surfaces 22, 23 is shown in detail in the exploded view which is FIG. 2.

Figure 2:
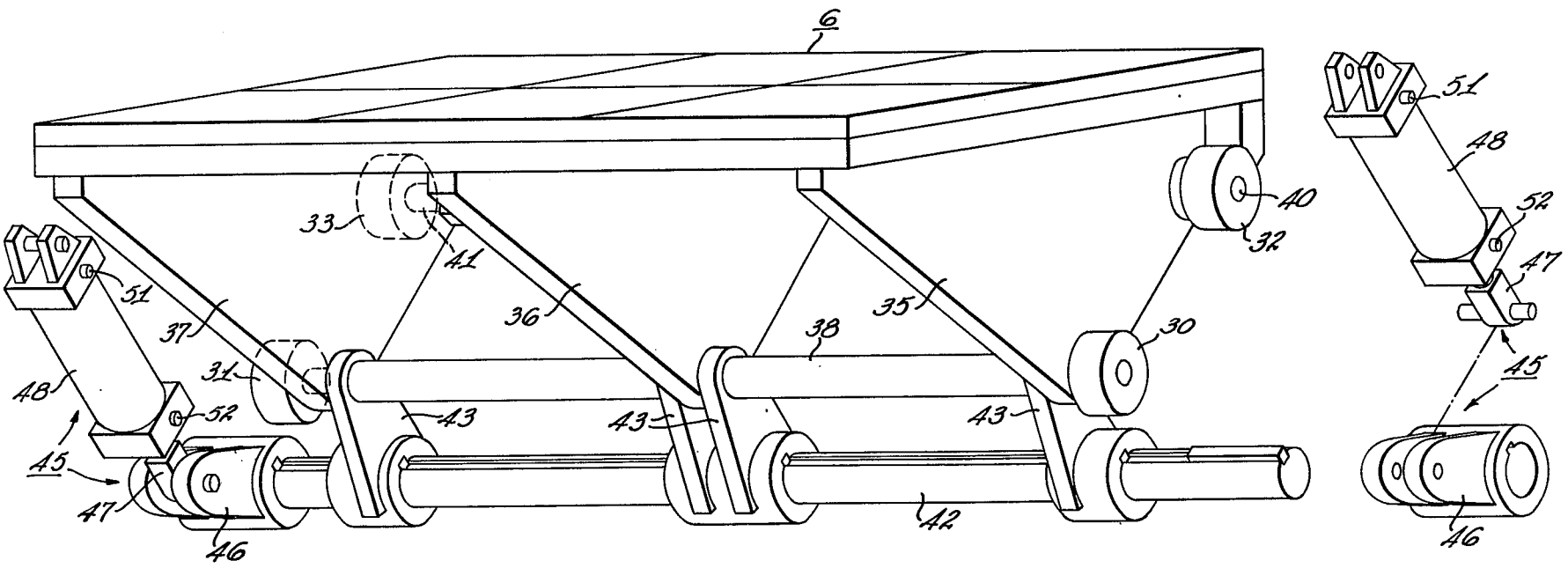
FIG. 2 is an enlarged and exploded view of a feed chute for the crusher shown in FIG. 1.

Referring to FIG. 2, the chute 6 is shown as having a first pair of cam following rollers 30, 31 and a second pair of cam following rollers 32, 33. The rollers of each pair are horizontally spaced apart and depend from chute 6 to engage the cam surfaces 22, 23 shown in FIG. 1 and another such cam surface (not shown) on the opposite side of casing 1. With further reference to FIG. 2, the chute 6 has depending ribs 35, 36 and 37, and the first pair of cam following rollers 30, 31 are each mounted on a common shaft 38 passing through each of the ribs 35, 36 and 37. The rollers 32, 33 of the second pair are each mounted on a stub shaft 40 and 41, respectively, with shaft 40 being journalled in rib 35 and shaft 41 journalled in rib 37. A crankshaft 42 is spaced from chute 6 by a plurality of crank arms 43 which are keyed to crankshaft 42 on one end and on the opposite end are connected to shaft 38. A fluid pressure expansible articulated arm 45 is provided for turning crankshaft 42 and arm 45 comprises a bifurcated lever arm 46 keyed to crankshaft 42 and pivotally connected to a piston rod 47 projecting from a fluid pressure operated cylinder motor 48.

The construction and operation of the fluid pressure expansible articulated arm 45 per se comprises no part of the present invention and the two cylinder motors 48 herein disclosed may be as shown and described in U.S. Pat. No. 3,202,367 of Aug. 24, 1965 (referred to earlier in this specification) with regard to cylinder motors 175, 176 shown in FIG. 10 of that patent. The arm 45 described herein may be caused to operate under the same conditions, circumstances, and in the same manner as described in the aforesiad U.S. Pat. No. 3,202,367 at column 8, lines 15–49, and therefore likewise per se comprises no part of the present invention.

Referring once again to FIG. 1, it is shown that the crankshaft 42 is journalled in the wall member 20 and casing 1 beneath the horizontal portion 22 of the cam surface and beneath the upper half of chute 6. The expansible articulated arm 45 is arranged external to casing 1 with the lever arm 46 being connected to an end of crankshaft 42 projecting through and outwardly of casng 1, and the end of cylinder 48 remote from crankshaft 42 being pivotally connected to a bracket 50 secured to the exterior of housing 1 at a location above chute 6 and spaced closer to the vertical plane X–X' than the space between crankshaft 42 and vertical plane X–X'.

In the operation of the invention, fluid pressure is ported (through ports 51, 52 in FIG. 2) to cause arms 45 to expand and turn crankshaft 42 counterclockwise as viewed in FIG. 1. This turning of crankshaft 42 moves the lever 46 from the position shown in FIG. 1 by solid lines, and with cam follower 30 on horizontal cam surface 22, to the position shown in phantom lines whereby cam follower 30 has followed the downwardly curved portion 23 of the cam surface and chute 6 is moved to the position shown in phantom lines. Thus when a large rock bridges the space between any location on chute 6 and a target bar such as one of the bars 11, and such a rock is being held above the range of hammers 7, the chute 6 is moved from the position shown in solid lines to the position shown in phantom lines. The movement between those two positions is that of moving the chute away from the target bars 11 and simultaneously tilting the upper end of chute 6 downwardly toward a horizontal position. Therefore the chute moves to lower or drop a bridged rock into the range of the whirling hammers regardless of whether the bridging rock is resting on the chute near its upper end or near its lower end.

From the foregoing detailed description of the present invention it has been shown how the objects of the present invention have been attained in a preferred manner. However, modification and equivalents of the disclosed concepts such as readily occur to those skilled in the art are intended to be included in the scope of this invention. Thus, the scope of the invention is intended to be limited only by the scope of the claims such as are or may hereinafter be, appended hereto.

We claim:

1. A crusher having a housing enclosing a rotor carrying hammers arranged to strike and throw input material to disintegrate upon impact with target members spaced from the rotor, and an improved input material feed assembly on a side of a vertical plane through the axis of the rotor, opposite at least some of the target members; and said feed assembly comprising:

(a) a pair of horizontally spaced vertical parallel side walls perpendicular to the rotor axis;

(b) a feed chute extending transversely between said side walls;

(c) camming means supporting said chute relative to the side walls with the chute inclined downwardly toward the rotor and having a material discharge lip in close proximity to the rotor; and (d) said camming means including an element carried by the side walls to turn an engaging member connected to the chute about a fixed horizontal axis beneath the upper end of the chute, and said element having a portion for moving the engaged member downwardly and away from the rotor to move the chute away from the rotor and tilt the upper end of the chute downwardly toward a horizontal position.

2. A crusher having a housing enclosing a rotor carrying hammers arranged to strike and throw input material to disintegrate upon impact with target members spaced from the rotor, and an improved input material feed assembly on a side of a vertical plane through the axis of the rotor, opposite the target members; and said feed assembly comprising:

(a) a pair of horizontally spaced vertical parallel side walls perpendicular to the rotor axis, each defining a cam surface having a horizontal portion and a downwardly curved portion at the end of the horizontal portion remote from the rotor;

(b) a feed chute normally inclining downward toward and in close proximity to the rotor, and having a pair of horizontally spaced cam surface followers depending from said chute with each follower engaging the horizontal portion of one of said cam surfaces; and (c) an actuating device connected to the chute for moving the chute and said cam followers along said cam surface and down the curved portion thereof, to move the chute away from the rotor and target members while tilting the upper end of the chute downwardly toward a horizontal position.

3. A crusher according to claim 2 having a second pair of horizontally spaced cam surface followers depending from said chute between the first pair of followers and the rotor, with each follower of the second pair being arranged to engage the horizontal portion of one of said cam surfaces and move along the horizontal portion as the followers of the first pair move down the curved portions of the cam surfaces.

4. A crusher according to claim 2 in which said actuating device is a mechanism comprising:

(a) a crankshaft journalled in said side walls beneath the horizontal portion of the cam surface;

(b) a crank arm connecting the crankshaft to the first cam surface followers; and (c) means for turning the crankshaft and crank arm to move the first followers along the cam surface and down the curved portion thereof.

5. A crusher according to claim 4 in which the means for turning the crankshaft is a fluid pressure expansible articulated arm connected on one end to the crankshaft and pivotally connected on the other end to the housing at a location above the chute and spaced closer to a vertical plane through the axis of the rotor, than the space between the crankshaft and the vertical plane through the axis of the rotor.

* * * * *